US006676138B1

(12) United States Patent
Rosso

(10) Patent No.: US 6,676,138 B1
(45) Date of Patent: Jan. 13, 2004

(54) ROLLER SKATE

(76) Inventor: Michele Rosso, Via Villa No. 122, Giaveno (Torino) (IT), 10094

( * ) Notice: Subject to any disclaimer, the term of this patent is extended or adjusted under 35 U.S.C. 154(b) by 0 days.

(21) Appl. No.: 09/936,187

(22) PCT Filed: Feb. 28, 2000

(86) PCT No.: PCT/IB00/00211

§ 371 (c)(1),
(2), (4) Date: Sep. 10, 2001

(87) PCT Pub. No.: WO00/53276

PCT Pub. Date: Sep. 14, 2000

(30) Foreign Application Priority Data

Mar. 11, 1999 (IT) ..... TO99A00189

(51) Int. Cl.[7] ..... A63C 17/04

(52) U.S. Cl. ..... 280/11.221; 280/87.041; 280/87.01; 280/842; 188/5

(58) Field of Search ..... 280/11.221, 11.201, 280/11.214, 11.233, 11.25, 87.1, 87.2, 87.041, 87.042, 86.758, 771, 492; 188/5, 6, 7, 109

(56) References Cited

U.S. PATENT DOCUMENTS

| | | | | | |
|---|---|---|---|---|---|
| 7,345 | A | * | 5/1850 | Saladee | 280/11.233 |
| 538,526 | A | * | 4/1895 | Lahey | 280/11.233 |
| 566,694 | A | * | 8/1896 | Libbey | 280/11.233 |
| 619,370 | A | * | 2/1899 | Wagner | 280/11.233 |
| 622,815 | A | * | 4/1899 | Lindsley | 280/11.233 |
| 857,925 | A | * | 6/1907 | Cure | 280/11.233 |
| 1,150,966 | A | * | 8/1915 | Ries | 280/11.233 |
| 1,164,798 | A | * | 12/1915 | Felley | 280/11.233 |
| 1,334,609 | A | * | 3/1920 | Guindon | 280/11.233 |
| 1,345,038 | A | * | 6/1920 | Uppling | 280/11.233 |
| 1,687,739 | A | * | 10/1928 | Slusher | 280/11.233 |
| 1,703,936 | A | * | 3/1929 | Jervoise | 280/11.233 |
| 3,484,116 | A | * | 12/1969 | Allen | 280/11.233 |
| 3,767,220 | A | * | 10/1973 | Peterson | 280/11.233 |
| 3,876,217 | A | * | 4/1975 | Copier | 280/11.225 |
| 4,445,699 | A | | 5/1984 | Darasko | |
| 5,398,950 | A | * | 3/1995 | Tkaczyk | 280/11.233 |
| 5,704,617 | A | * | 1/1998 | Stoughton et al. | 280/11.233 |
| 6,042,138 | A | * | 3/2000 | Shreck | 280/492 |

FOREIGN PATENT DOCUMENTS

| | | | |
|---|---|---|---|
| DE | 27 26 961 | A | 1/1979 |
| DE | 295 10 301 | U | 11/1995 |
| FR | 959 743 | A | 4/1950 |

OTHER PUBLICATIONS

PCT International Search Report dated Jun. 6, 2000.

* cited by examiner

*Primary Examiner*—Brian L. Johnson
*Assistant Examiner*—Hau Phan
(74) *Attorney, Agent, or Firm*—Carlson, Gaskey & Olds

(57) ABSTRACT

A shoe-plate, adapted to hold a boot of a user, is pivotally mounted on the middle portion of an elongated frame. The frame has one or two rear wheels and a fork pivoted on its front portion around a vertical axis, and supporting a front wheel. Steering system connect the shoe-plate with the fork so that a pivotal movement of the shoe-plate causes a pivotal movement of the fork. The shoe-plate may be pivoted around a vertical or a longitudinal, horizontal axis. In the latter case, the skate also comprises adaptable restraining system connecting the trunk of the user to the frame.

13 Claims, 5 Drawing Sheets

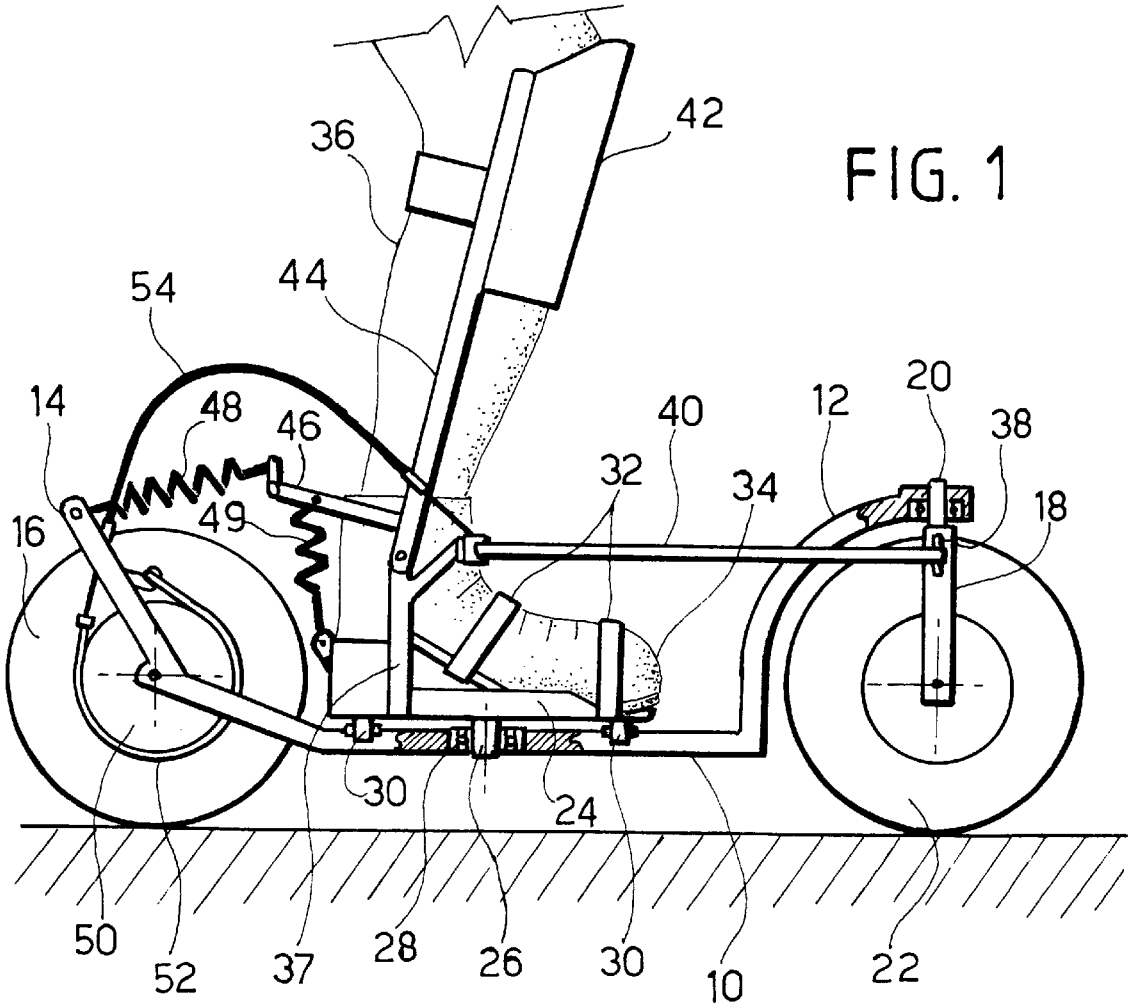
FIG. 1
FIG. 2
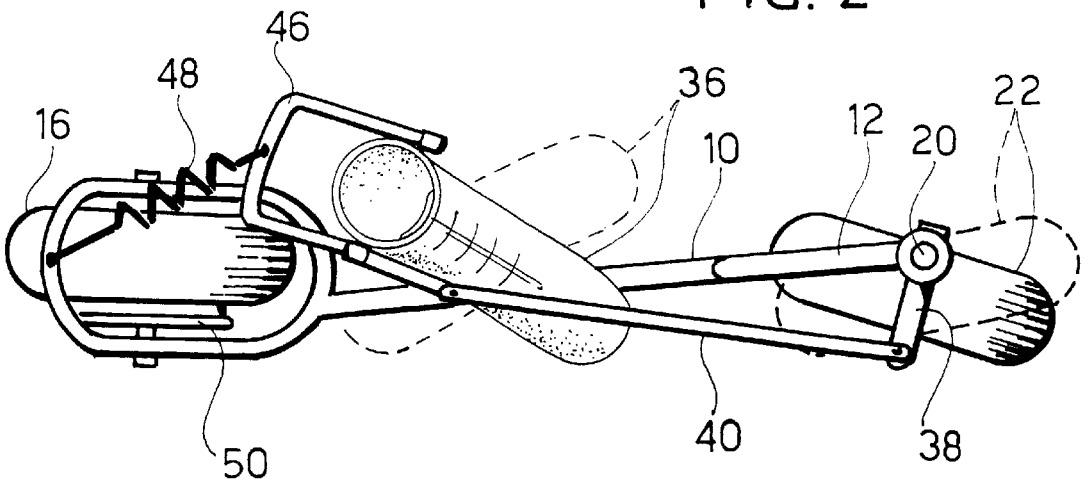

FIG. 3
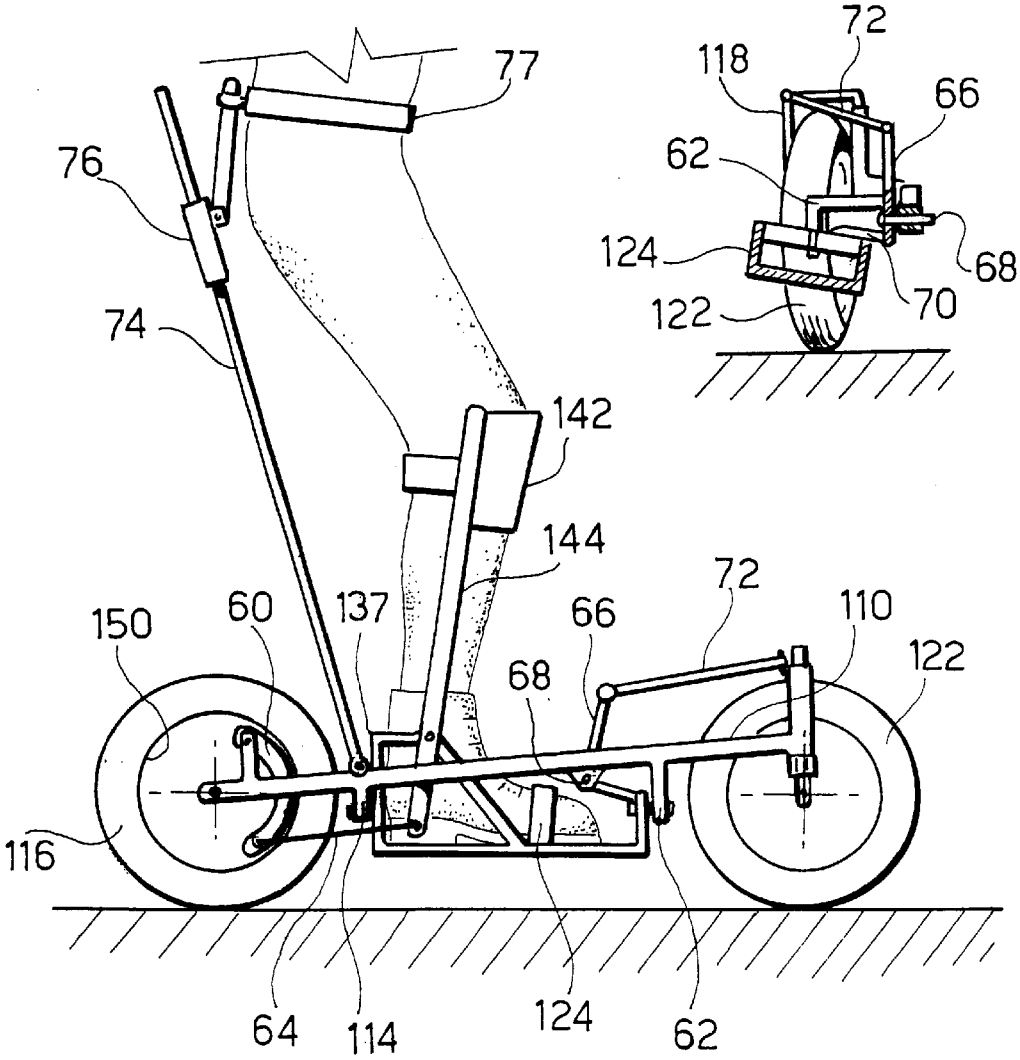
FIG. 5
FIG. 4
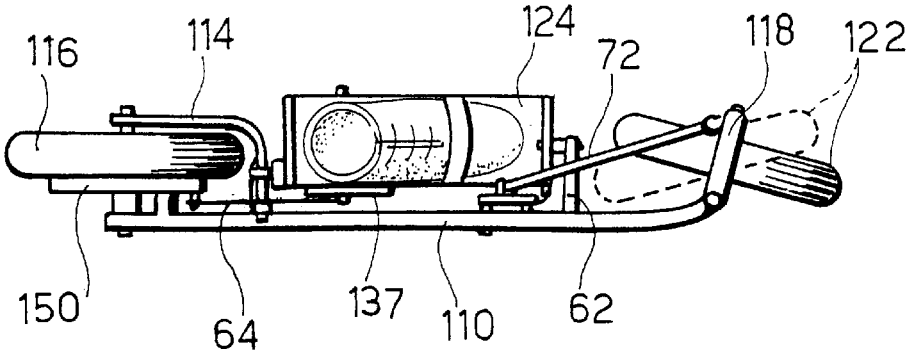

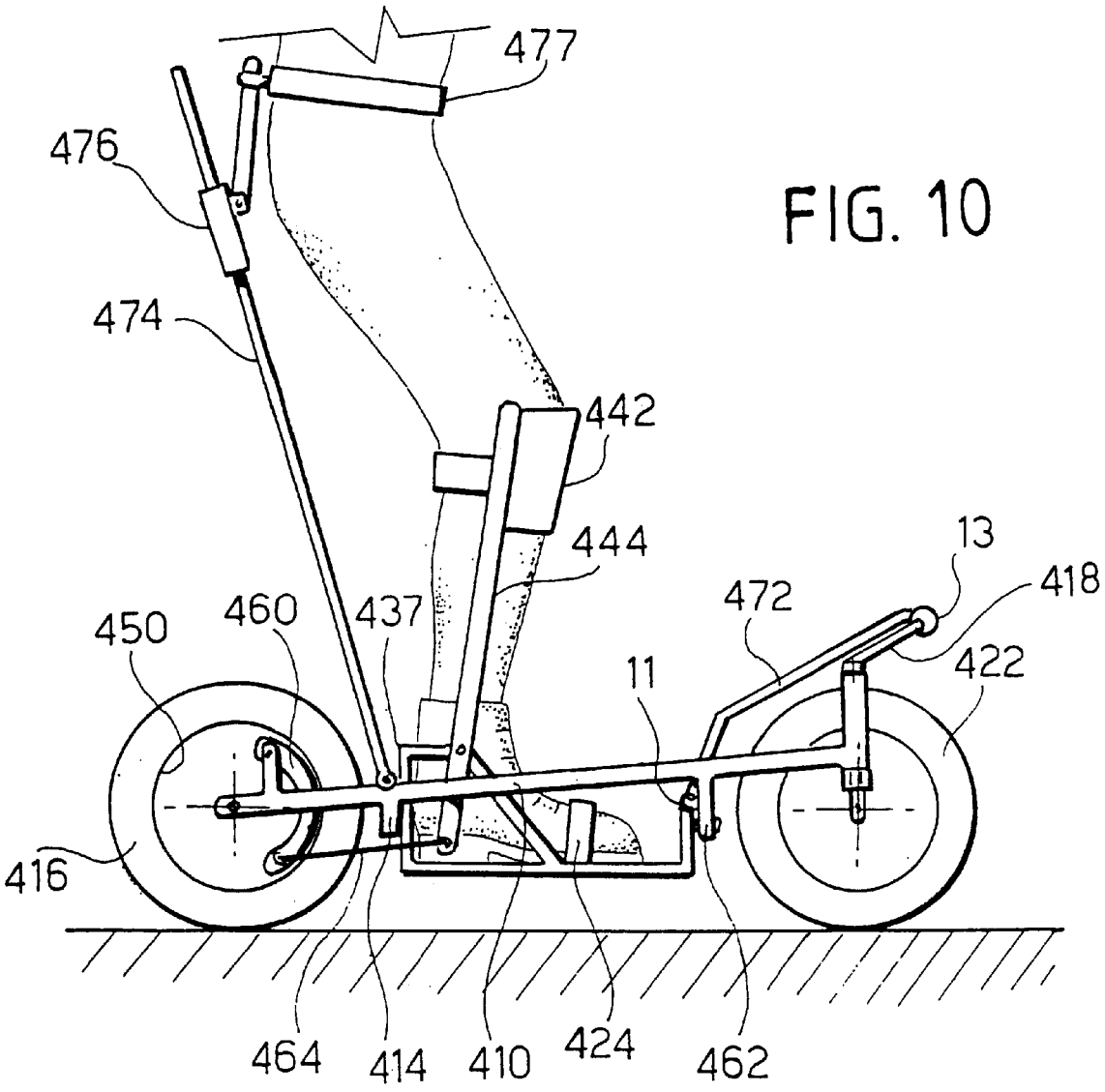
FIG. 10
FIG. 11
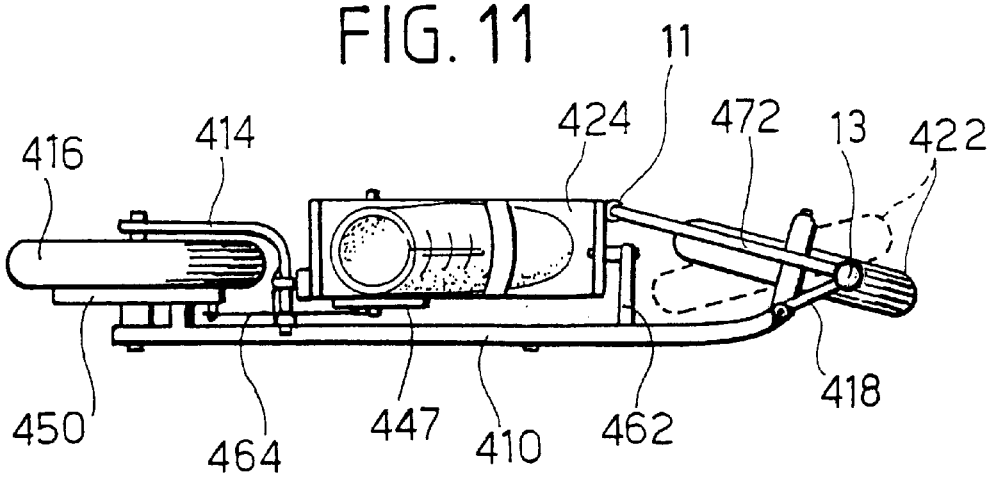

ROLLER SKATE

BACKGROUND OF THE INVENTION

This invention is concerned with a roller skate, particularly for use on steep or rough mountain slopes.

Mountain skiers are used to, and draw enjoyment from, descending slopes at varying speeds and following arbitrary paths which include a number of sharp bends. This sport, however, can only be practiced in wintertime and while the slopes are covered with snow, and sportsmen are thus deprived of their favorite amusement for long periods of the year.

SUMMARY OF THE INVENTION

It is now the main object of the invention to provide a roller skate which can be used by sportsmen to run down slopes, such as meadows or dirty ground, whether bare or covered with snow, following any desired path including changes of direction, and using a technique that is quite similar to the technique used while skiing on snow.

It is another object of the invention to provide a roller skate as above, which can be used safely also on very steep or rough ground, such as the same mountain slopes used by skiers when they are covered with snow.

The invention achieves the above and other objects and advantages with a roller skate having the features recited in claim 1.

Other advantageous features are set out in the subordinate claims.

BRIEF DESCRIPTION OF THE DRAWINGS

The invention will now be disclosed in more detail with reference to a few preferred embodiments, as shown in the attached drawings, wherein:

FIG. 1 is a side view of a roller skate according to a first embodiment of the invention;

FIG. 2 is a plan view of the roller skate of FIG. 1;

FIG. 3 is a side view of a roller skate according to a second embodiment of the invention;

FIG. 4 is a plan view of the roller skate of FIG. 3;

FIG. 5 is a view in cross-section made along line V—V of FIG. 3, while the skate is executing a bend;

FIG. 10 is a side view of a roller skate according to a fifth embodiment of the invention; and FIG. 11 is a plan view of the roller skate of FIG. 10.

DETAILED DESCRIPTION OF A PREFERRED EMBODIMENT

First Embodiment

Figure 6:
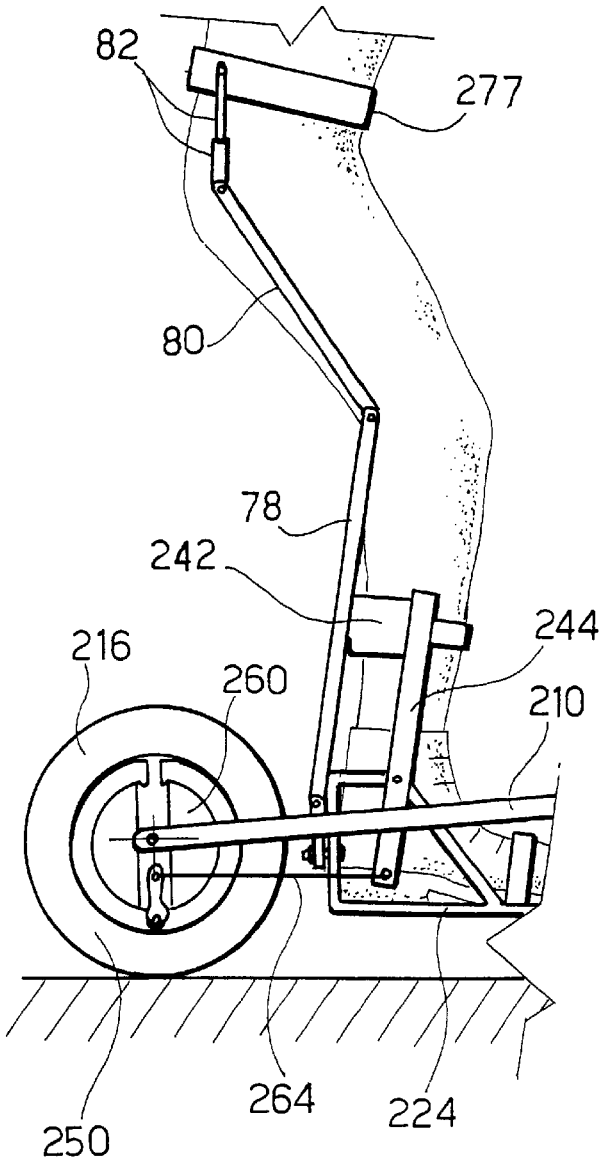
FIG. 6 is a side view of a person, partly broken away, wearing roller skates according to a third embodiment of the invention.

FIGS. 1 and 2 show the first embodiment of the invention. An elongated frame 10, preferably made of steel or of another suitable alloy, comprises a middle, straight portion which extends forward into an arched portion 12, and extends rearward into a loop-shaped portion 14.

A rear wheel 16 is rotatably supported within loop-shaped portion 14. A fork 18 is pivoted in 20 at the forward end of arched portion 12 of the frame, around a substantially vertical axis, and a front wheel 22 is rotatably supported within fork 18. Both wheels 16 and 22 are provided with soft pneumatic tires.

A shoe-plate 24 is rotatably supported upon middle portion of frame 10 by a pivot 26 projecting integrally from the shoe-plate and received within a ball bearing 28 in the frame. For stability, the portions of shoe-plate 24 located before and behind pivot 26 ride on idle rollers 30 that are mounted on horizontal axes in frame 10. Shoe-plate 24 is shaped with ribs and retaining straps 32 defining a socket to firmly hold a boot 34 of a user, one leg of a user being shown as 36 in FIG. 1. Two uprights such as 37 extend upwardly from the sides of the shoe-plate.

A bracket 38 extends laterally from fork 18, and the end of bracket 38 is linked to a point on one of uprights 37 on shoe-plate 24 by means of a rod 40, so that when the shoe-plate is turned right or left on its pivot 26, wheel 22 will also be turned accordingly.

A knee-piece 42, which is strapped to the user's leg, has two integral staffs 44 that are respectively linked to uprights 37 of shoe-plate 24, and a bridge 46 connects integrally the lower ends of both staffs. A tension spring 48 connects corresponding points on bridge 46 and on loop-shaped portion 14, to act as a biasing spring to a neutral position of the shoe-plate, to return the front wheel to a straight position after a bend. Another tension spring 49 connects bridge 46 downward to a low point on the shoe-plate, in order to help the user to straighten up after a squat.

Rear wheel 16 is also provided with a lateral drum 50. A braking belt 52 having one end attached to the frame is wound around drum 50 and has its opposite end attached to a Bowden cable 54 that has its own opposite end attached to upright 37 and its sheath attached to one of staffs 44, so that the belt is tensioned when the user leans back.

In operation, a user wears one of the above skates on each foot, and will also normally hold ski poles in his hands (not shown). On a slope, the skates will run freely on their wheels, and the user can maintain the frames upright by appropriate use of leg muscle action. Balance is made easier by the low position of the foot, which is closer to ground than the turning axes of the wheels. In order to change direction, the user forces his foot to point to the appropriate side, thus turning the front wheel. In order to brake, the user leans back, so that his lower leg will incline staffs 44 rearward and will draw Bowden cable 54, which will tension the braking belt. The large diameter of the wheels, as well as the action of the tires, allow the skate to take even very rough terrain in stride.

When using a pair of skates as described above, the user can reproduce most of the movements and operations of a pair of skis, such as running diagonally along a slope, frequently changing direction, dynamically maintaining balance against disturbing forces, jumping or momentarily lifting the skate from the ground, in order to overcome or avoid small obstacles. However, in addition to the operations available when skiing, the skate of the invention is also capable of being braked.

Many improvements can be made to the skate as described above, which have not been shown for the sake of simplicity. Instead of the strapped shoe-plate shown, a safety shoe-plate could be used, similar to a safety ski-binding. Also, wheels 16 and 22 are preferably supported for unidirectional rotation, so that the user can climb up short slopes by walking the skates, without the wheels turning backwards. Such unidirectional couplings are well known in the art, such as in bicycles and the like, and do not require description.

Second Embodiment

A second embodiment of the invention will now be described with reference to FIGS. 3, 4 and 5, where parts having a counterpart in FIGS. 1 and 2 bear the same reference number with a prefix of 1.

An elongated frame 110 has a bracket 114 at its rear end and a pivoted fork 118 at its front end. A rear wheel 116 is rotatably supported in fork 114 and a front wheel 122 is rotatably supported in fork 118. Wheel 116 is provided with a brake drum 150 and with an internal brake-shoe 60 that is pivoted on the frame. This structure, although different in detail, is equivalent to the corresponding structure of the skate of FIGS. 1 and 2.

Frame 110 also has a bracket 62, and a shoe-plate 124 is supported between brackets 114 and 62, so that it is freely rotatable around a horizontal axis that is longitudinal to the frame. Shoe-plate 124 is similar to shoe-plate 24 of FIGS. 1 and 2, and has uprights 137 which are linked with staffs 144 from knee-pieces 142. An extension of one of staffs 144 is connected by a tierod 64 with the free end of brake-shoe 60 for causing a braking action when the user leans backward.

A linkage connects shoe-plate 124 to an eccentric point of bracket 118. The linkage comprises a rocking lever 66 that is pivoted to a point 68 on the frame, and respective link rods 70 from one end of rocking lever 66 to the shoe-plate, and 72 from the opposite end of the rocking lever to the fork. A rotation of shoe-plate 124 around its horizontal axis is therefore converted into a rotation of fork 118 around its vertical axis.

In order to allow the user to control the lateral inclination of the skates, and thus maintain stability in spite of the freedom of the shoe-plate with respect to the frames, the skate of FIG. 3 further comprises a rod 74 that is pivoted on the frame around a substantially horizontal axis at right angles to the longitudinal direction of the frame. A slidable sleeve 76 is received on rod 74 and is linked to a harness 77 worn by the user. It can be seen that, while the trunk allows the user to lean backward and forward, or to squat and rise, the rod-and-sleeve joint will always maintain the frame aligned with the user's trunk.

The skate of this embodiment is ridden similarly to the first embodiment, but steering is achieved by flexing the foot laterally, i.e. inclining the foot around a longitudinal axis, typically by shifting the knees in the opposite direction, as well known to skiers.

The skate of the second embodiment has the advantage of allowing the user to steer the skates by an action (the lateral inclination of his feet) that corresponds more closely to the action used when skiing, and therefore the user does not have to learn a new technique as was necessary with the skate of the first embodiment (turning the feet right or left). On the other hand, this embodiment requires a connection of the trunk of the user to the skate frame, which was not necessary with the first embodiment.

Third Embodiment

Figure 7:
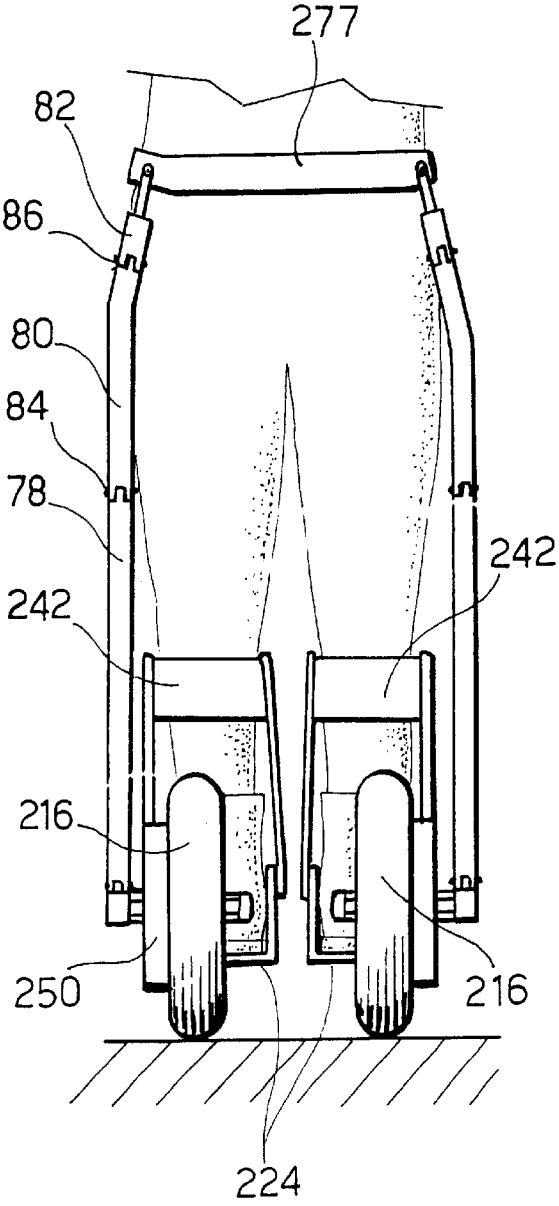
FIG. 7 is a rear view in the direction VII of FIG. 6.

A third embodiment of the invention is shown on FIGS. 6 and 7, where parts having a counterpart in FIGS. 1 to 5 bear the same reference number with a prefix of 2.

The third embodiment is quite similar to the second embodiment except that the rod-and-sleeve linkage from the frame to the wearer's trunk is here replaced by a hinged linkage. The hinged linkage has three sections 78, 80, 82, which are joined together by hinges 84, 86, having respective axes which are at right angles to the longitudinal direction of the frame. The lower section 78 is hinged to frame 210, while the upper section 82 is attached to a harness 277.

When the user squats, the three sections will variously bend around the hinges to adjust to the user's movements, while maintaining parallelism between the user's trunk and the frame. The three sections 78, 80, 82 are sized for substantially copying the sizes of the user's thighs and shins.

This embodiment of the skate is used in the same way as the second embodiment.

Other kinds of restraining means, equivalent to the rod-and-sleeve linkage or to the hinged linkage, can be devised. For instance, a telescoped pole or a pantograph linkage could be substituted for the hinged pole.

Fourth Embodiment

Figure 8:
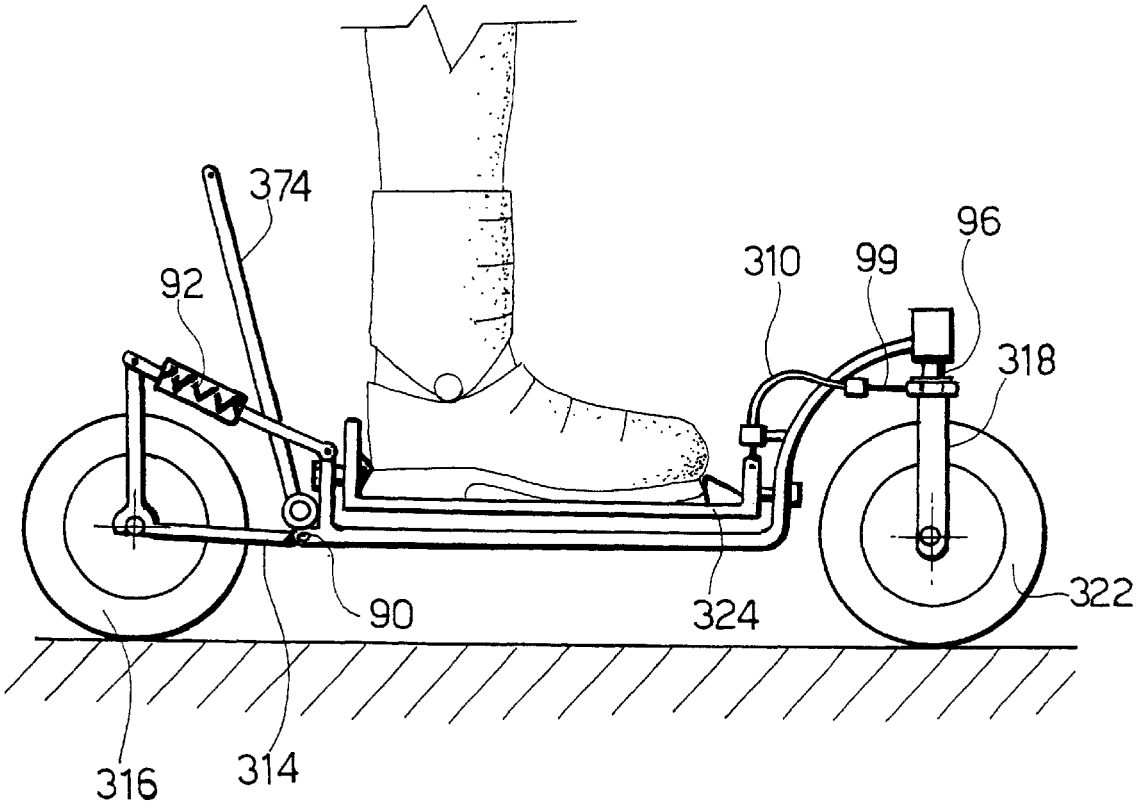
FIG. 8 is a side view of a roller skate according to a fourth embodiment of the invention.
Figure 9:
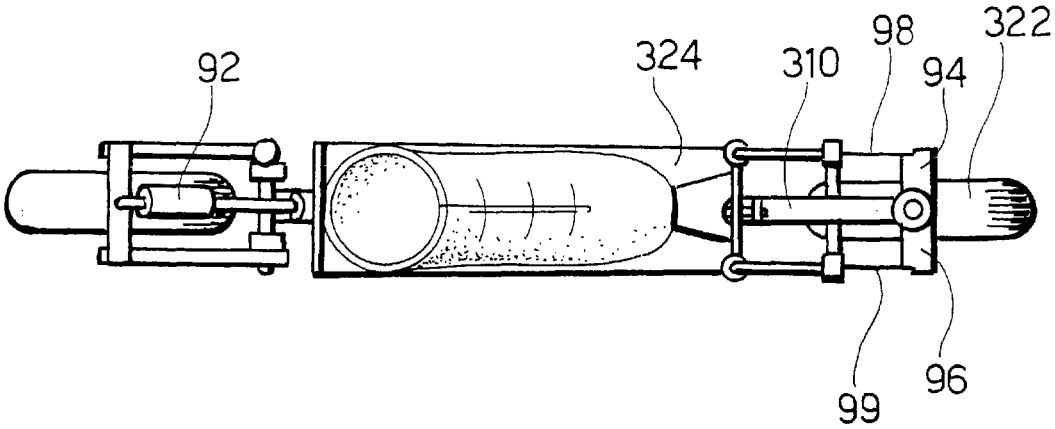
FIG. 9 is a plan view of the roller skate of FIG. 8.

A fourth embodiment of the invention is shown on FIGS. 8 and 9, where parts having a counterpart in FIGS. 1 to 7 bear the same reference numbers, with a prefix of 3.

This embodiment again has a shoe-plate 324, pivotally mounted on a frame 310, so that it is freely rotatable around a horizontal axis that is longitudinal to the frame. Shoe-plate 324 is structured as a ski safety binding, as known to a person skilled in the art. Frame 310 has a rear portion 314 where a wheel 316 is rotatably supported. The rear portion is hinged to the middle portion in 90, and a shock absorber 92 is connected therebetween to improve the performance of the skate on rough ground.

A fork 318 is pivoted at the front portion of the frame, similarly to the fork of the previous embodiments, and has opposite brackets 94, 96 projecting laterally. Each of the brackets is connected to opposite sides of shoe-plate 324 through respective Bowden cables 98, 99, so that an inclination of the shoe-plate from the horizontal position will pull on one of the Bowden cables and therefore on the corresponding bracket, 94 or 96, of fork 318, to turn the wheel. The Bowden cables could be replaced with flexible strings or belts, running over free-running pulleys supported on the frame.

For simplicity, a brake has not been shown in FIGS. 8 and 9, but it should be understood that the skate will normally include a brake similar to any of those shown in the previous Figures.

The roller skate of FIGS. 8 and 9 is used similarly to the skate of the previous embodiments, with the advantage of a smoother ride on rough ground, due to the shock absorber 92.

Fifth Embodiment

A fifth embodiment of the invention is shown on FIGS. 10 and 11, where parts having a counterpart in FIGS. 1 to 9 bear the same reference number with a prefix 4.

The fifth embodiment is, again, quite similar to the second embodiment except that the rod-and-rocker linkage from the shoe-plate to the bracket on the front wheel fork is here replaced by a single curved tierod 472, whose ends are respectively linked to a lateral point of the shoe-plate through a ball joint 11, and to the distal end of bracket 418 through a second ball joint 13. Moreover, bracket 418 (in contrast with bracket 118 of FIG. 4) is slanted upward. Tierod 472 is preferably adjustable in length, by an arrangement not shown in the drawings, e.g. by providing the tierod with a screwed portion at one end.

It is easy to see that, because of the eccentric connections and because of the ball joints allowing two degrees of freedom to the jointed parts, a rotation of the shoe-plate around its horizontal axis will raise or drop the adjacent end of tierod 472, and correspondingly move the opposite end, thus steering the front wheel accordingly. This embodiment has the advantage of a very simple mechanical structure.

A few preferred embodiments of the roller skate on the invention have been described, but it should be understood that further modifications can be made to them within the scope of the invention. For instance, knee-piece 42 or 142, instead of being supported by hinged staffs, might also be supported by flexible rods which are integral with uprights 47 or 147. The steering mechanism could take other forms, including use of gears and racks.

It should also be noted that, although the skates of the invention are mainly intended for being used in pairs, one being worn on each foot of the user, one skate could also be used singly, by having one foot of the user strapped to the shoe-plate, and the other foot resting forward on the frame during the ride, and being laid on the ground during stops. For this mode of riding, the skate might be modified to have a pair of rear wheels placed side by side, for better stability.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A roller skate comprising:

an elongated frame having a middle portion, a front portion and a rear portion;

a shoe-plate for supporting a boot of a user, wherein the shoe-plate is pivotally mounted around a shoe axis on the middle portion of the frame;

at least one rear wheel that is rotatably mounted on the rear portion of the frame for turning around a horizontal rear axis;

a fork pivoted on the front portion of the frame, for turning around a substantially vertical axis;

a front wheel that is rotatably mounted on the fork, for turning around a horizontal front axis;

a steering system connecting the shoe-plate with the fork so that pivotal movement of the shoe-plate causes pivotal movement of the fork;

a brake on said rear wheel, and a brake operating system for operating the brake, wherein the brake operating system comprises at least one substantially vertical staff hingedly connected to said pivoting shoe plate and pivotable around said shoe axis with respect to said elongated frame when said shoe plate is rotated, wherein said at least one staff is operably connected to said brake such that the staff inclines rearward when a user leans a lower leg backward to operate said brake.

2. The roller skate of claim 1, wherein the shoe-plate is pivoted around a substantially vertical shoe axis.

3. The roller skate of claim 2, wherein said steering system includes a bracket on the fork and a rod linking the bracket to the shoe-plate.

4. The roller skate of claim 2, wherein the roller skate further comprises an elastic member biasing the shoe-plate to a neutral position of alignment with a longitudinal direction of the frame.

5. The roller skate of claim 1, wherein the shoe-plate is pivoted around a substantially horizontal shoe axis, and in that the skate further comprises a restraining system joining the frame to a user's body for maintaining the frame aligned with the body.

6. The roller skate of claim 5, wherein said restraining system is adapted to maintain the frame aligned with the body while allowing the body to be lowered.

7. The roller skate of claim 6, wherein said restraining system includes a rod pivoted to the frame around a rod axis at right angles to a vertical longitudinal plane of the frame, and a sleeve slidable on the rod and fastenable to the body of the user.

8. The roller skate of claim 6, wherein said restraining system includes a hinged linkage having a first end attached to the frame and adapted to bend around an axis at right angles to a vertical longitudinal plane of the frame, a second end of the hinged linkage being fastenable to the body of the user.

9. The roller skate of claim 6, wherein said steering system includes a bracket on the fork and a rod linking the bracket to the shoe-plate through a pair of respective ball joints.

10. The roller skate of claim 1, wherein the axes of both of said wheels are higher than the middle portion of the frame when the wheels rest on the ground.

11. The roller skate of claim 1, wherein the wheels are tires.

12. The roller skate of claim 1, wherein the wheels are supported on a unidirectional supports allowing rotation only in a forward direction.

13. The roller skate of claim 1, wherein said steering system includes a bracket on the fork and a rod linking the bracket to the shoe-plate to the bracket.

* * * * *

UNITED STATES PATENT AND TRADEMARK OFFICE

CERTIFICATE OF CORRECTION

PATENT NO. : 6,676,138 B1
DATED : January 13, 2004
INVENTOR(S) : Rosso

It is certified that error appears in the above-identified patent and that said Letters Patent is hereby corrected as shown below:

Column 6,
Lines 52-53, "rod linking the bracket to" should read as -- linkage from --

Signed and Sealed this

Eleventh Day of May, 2004

JON W. DUDAS
*Acting Director of the United States Patent and Trademark Office*